United States Patent [19]

Frazier

[11] 4,016,668

[45] Apr. 12, 1977

[54] FIRING MECHANISM FOR FIREARM

[75] Inventor: Gerald Joseph Frazier, Melrose, Mass.

[73] Assignee: Frazier Gun Co., Melrose, Mass.

[22] Filed: Jan. 15, 1976

[21] Appl. No.: 649,412

[52] U.S. Cl. ..... 42/69 R; 42/41

[51] Int. Cl.[2] ..... F41C 19/00

[58] Field of Search ..... 42/69 R, 69 B, 41, 42 R

[56] References Cited

UNITED STATES PATENTS

| | | | |
|---|---|---|---|
| 266,245 | 10/1882 | Whitmore | 42/41 |
| 464,215 | 12/1891 | Conner | 42/41 |
| 939,112 | 11/1909 | Tambour | 42/41 |
| 1,998,596 | 4/1935 | Stiennon | 42/69 R |
| 2,558,871 | 7/1951 | Miller | 42/41 |
| 2,935,808 | 5/1960 | Woodring et al. | 42/69 R |
| 3,011,282 | 12/1961 | Sefried | 42/69 B |

*Primary Examiner*—Charles T. Jordan

[57] ABSTRACT

A firing mechanism for a firearm wherein a firing hammer is actuated by a firing spring and cam arrangement and wherein engagement between a sear and the hammer is arranged to provide a positive lock against misfire but simultaneously to provide a light trigger pull for firing in which, during the firing cycle, the hammer element moves in response to force applied to the sear only a small amount which is insufficient to bring the full force of frictional resistance of the firing spring and cam elements into play. The trigger is adjustable to facilitate attainment of the appropriate spacial relationships.

4 Claims, 3 Drawing Figures

FIRING MECHANISM FOR FIREARM

BACKGROUND

This invention relates to firing mechanisms for non-automatic firearms and more particularly to a firing mechanism of the above class suitable for use in a shot gun, which provides a high degree of sensitivity with regard to both the force necessary to discharge the firearm and the degree of movement of the mechanism required for such discharge, without loss of safety.

In the usual form of firing mechanism for non-automatic rifles and handguns, a trigger element is adapted to pivot about its mounting pin in response to a force applied to the trigger grip by the user of the gun. This movement of the trigger causes a corresponding movement of a sear element, which prior to firing, engages and holds a hammer in the cocked position. When the trigger is pulled, it pivots the sear out of engagement with the hammer, thereby releasing the hammer and allowing it to move by spring force against the firing pin. When the firing mechanism is in the cocked position the spring force acting on the hammer, bears against the sear which in turn bears against the trigger and since these forces hold the firing mechanism in the cocked position, it is necessary that they exceed any normally encountered random shocks or counter-forces which might cause the sear to pull out of engagement with the hammer and thereby accidentally to fire the gun.

In some contexts, it has been found desirable to modify certain of the parameters of the firing mechanism in order to increase the sensitivity of firing. Thus, in target shooting for example the competitive nature of the activity increases the need for the firearm to fire with a light touch and to "feel right". There are many factors which influence the intangible "feel" of a firearm such as weight, balance, trigger pull (i.e. the force needed to move the trigger), the distance the trigger travels prior to discharge, and others. Some of these factors are basically fixed and an individual shooter must decide at the time of purchase of a firearm which blend of fixed parameters best fulfills his needs. Others can be adjusted.

Examples of the provision of certain types of adjustment in rifles and handguns in the prior art include variable tension springs, means for changing the position of the sear, and honing the sear. Many of these, however, have proved unsafe. Some have been used in rifles and pistols, but none has proved successful in shot guns. The reasons for this are subtle and not easily ascertained. Shot guns are comparatively light in comparison to other firearms of similar size and their firing mechanisms are generally comparatively simple in that automatic ammunition feed devices and the like are usually not employed. In addition, shot guns are primarily bird hunting firearms designed for quick aiming, ease of loading and firing in a field setting, and to give a hunter a wide "hit" area as compared with rifles. In such a context the exposure to random shocks which might cause a misfire is even greater than with other guns and gunsmith's have been opposed to "hair trigger" adjustments for shot guns for safety reasons. In some cases gunsmith's have engaged in honing the mating elements of the sear and hammer to reduce the angle therebetween. Such a practice is dangerous for two reasons. First, the honing may be too much, and second if it is not too much to begin with, it may become too much due to wear. Honing therefore is risky and should be done only with extreme care and a gun in which the sear has been honed should be used only with extreme care.

In trap shooting, however, for many years there has been a desire among shooters to be able to have not only a safe "hair trigger" when desired, but also to be able to vary trigger pull and travel, according to the users desires under different conditions. Additional objectives of such a firing mechanism are that it be simple in construction and not require significant alteration in the shot gun balance or increase the "kick" of the gun or the manufacturing cost. In addition it should be easy to use so the shooter need not waste valuable range time making adjustments, and it must be reversible allowing both greater and lesser "pull", unlike the "honing" of parts which is irreversible. In addition it must be stable in order to avoid accidental or premature discharge during storage or transport or as the shooter reacts to the lines up his shot with the flight of the "pigeon". Standard target shooting mechanisms and hitherto known adjusting means of which I am aware have been found unsatisfactory for these purposes especially in the trap shooting context.

SUMMARY OF THE INVENTION

The present invention therefore is directed to the provision of sensitive but yet safe firing mechanism. It is an object of this invention to provide a firing mechanism which is simple, easy to use, reversible in effect and sufficiently stable to assure that no premature discharge will occur even at a highly sensitive trigger setting.

The instant firing mechanism generally comprises a spring loaded firing hammer pivotally mounted so as to strike a firing pin when the gun is fired. A spring loaded sear is pivotally mounted adjacent to and under the hammer in position so that its front end or hammer-bearing corner can lodge in a sear receiving notch in the under side of the hammer, when the gun is in the cocked position. A pivotally mounted trigger is adapted to engage an arm extending from the opposite end of the sear and rotate the sear in response to a force applied to the finger grip portion of the trigger so as to disengage the hammer-bearing corner of the sear from the sear receiving notch when firing the gun. In addition, an adjusting screw is provided with arrangements to alter the position of the hammer-bearing corner in the sear receiving notch when the trigger is in the cocked or ready-to-fire position. As will appear more fully in the following detailed description of a preferred embodiment, superior results are achieved when the hammer-bearing corner of the sear extends angularly slightly above, but mates only with a sear-bearing corner portion of the sear receiving notch in such a way that a positive lock remains when the gun is cocked but at the same time substantial motion of the spring and cam arrangements bearing on the hammer during the firing stroke of the trigger is eliminated.

It is a feature of this arrangement that the hammer-bearing corner of the sear and the sear-bearing corner of the sear receiving notch overlap in such a way that ramdon shocks applied to any part of the gun except the trigger only tend to keep the sear firmly in the cocked position, but that during firing, the force of the sear against the hammer causes only such a slight counter-motion of the hammer in order to disengage the sear that the contact-viscosity bonds of the spring and cam arrangements acting on the hammer are not disturbed sufficiently to cause a heavy trigger pull. This provides "light tough" firing, but without loss of safety because the only elements made more sensitive by this arrangement are the sear and the trigger. The sear, however, is light and pivoted at a point near to its center of gravity. Therefore, random shocks do not tend to move it. The trigger is, of course, protected from random dislodgment by the trigger guard. In addition, in the arrangement of this invention, no trigger spring is employed. Thus, there is no spring force urging the trigger against the sear and therefore less tendency for the trigger to dislodge the sear from the sear receiving notch in the hammer. In addition, the trigger also is light and not prone to substantial motion due to inertial changes.

BRIEF DESCRIPTION OF THE DRAWINGS

These and additional features and advantages will become particularly clear in the following detailed description of a preferred embodiment of the present invention in relation to the drawing in which.

DETAILED DESCRIPTION OF A PREFERRED EMBODIMENT

Figures 1, 2, 3:
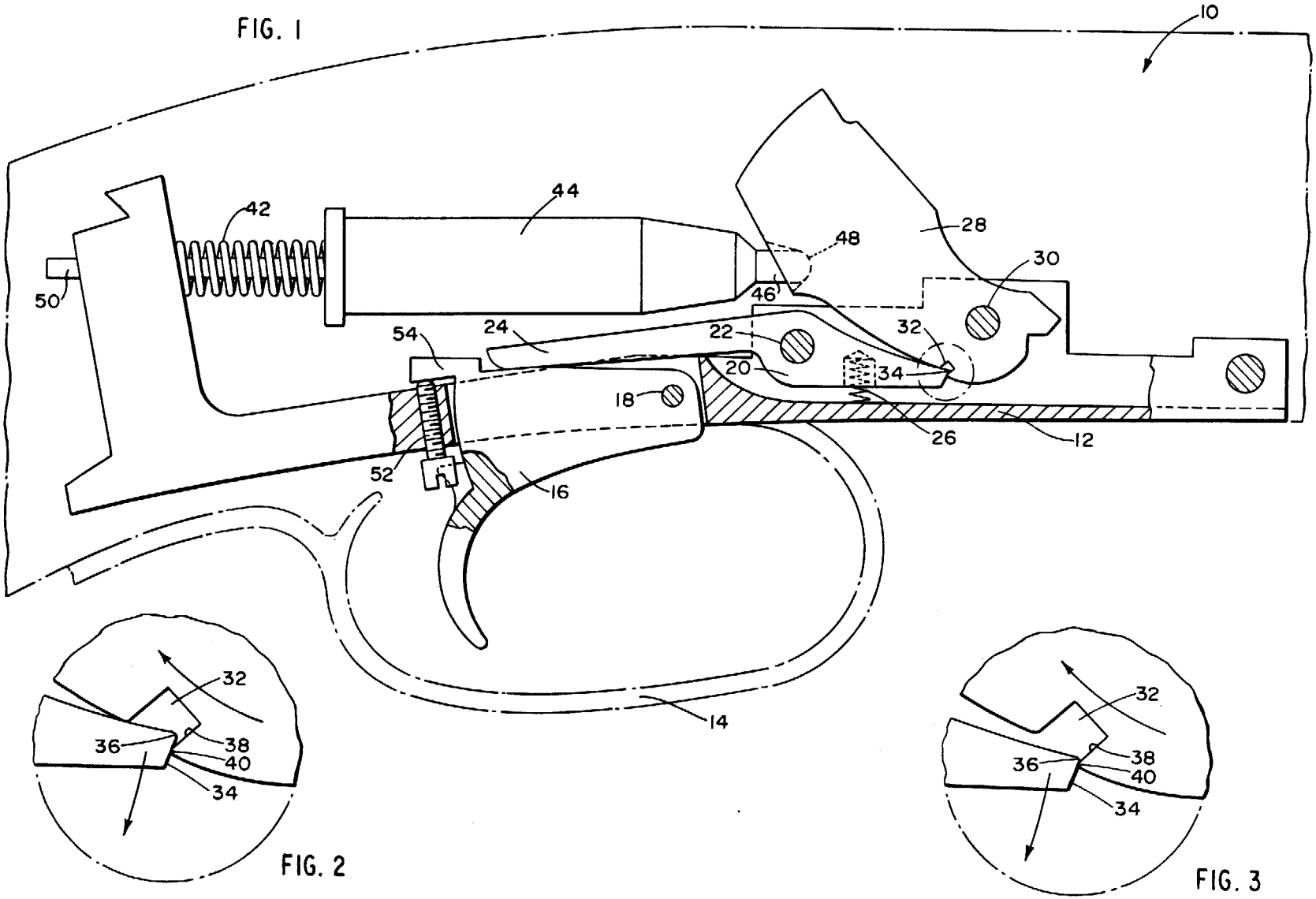
FIG. 1 shows a side view of a firing mechanism in accord with the present invention.
FIG. 2 is an enlarged side view showing the sear tip and hammer notch in the normal position.
FIG. 3 is an enlarged side view showing the sear tip and hammer notch in the position of the preferred embodiment.

In the preferred embodiment of my invention herein shown a shot gun is indicated generally at 10. The firing mechanism comprises a base member 12 internally of the gun at the mid-section thereof between the barrel portion (not shown) and stock portion (not shown). A trigger guard 14 is connected to the base 12 and extends downwardly therefrom.

The base member 12 is slotted centraly to receive a trigger 16 which is pivotally mounted at 18 to rotate in the slot. A sear 20 is similarly pivotally mounted above the trigger 16 on base 12 at 22. The sear 20 has a rearwardly extending arm 24 which bears against the upper surface of trigger 16. A sear spring 26 acts in compression between base 12 and the forward end of sear 20 so as to rotate the sear 20 in a counter-clockwise direction (as shown), thereby urging the trigger into the cocked, ready-to-fire, position.

A hammer 28 is positioned forward of and above the sear and is pivotally mounted on the base 12 at 30. The lower rear surface of hammer 28 is notched at 32 to receive the sear 20, when the gun is cocked. In detail (see FIGS. 2 and 3), the sear 20 is provided with a hammer-bearing surface 34 which terminates in a hammer-bearing corner 36, and the sear-receiving notch 32 is provided with a sear-bearing wall 38 terminating in a sear-bearing corner 40.

In FIG. 1, the firing mechanism is shown in the cocked position with the sear 20 in the sear-receiving notch 32. In this position the hammer 28 is being urged toward the firing position by a firing spring 42 which acts on hammer 28 through piston 44, and cam 46 bearing on hammer 28 in socket 48. The piston 44 is guided in its travel by rod 50.

When the gun is cocked, the hammer 28 is drawn backwardly against the force of spring 42. While this is taking place, sear spring 26 is urging hammer-bearing corner 36 upwardly against the under surface of hammer 28. When the hammer reaches the cocked position, notch 32 in its under surface pivots into position to recieve the hammer-bearing corner 36 and the sear 20 snaps upwardly into notch 32 in response to the force of sear spring 26. In this position the withdrawing force on hammer 28 may be released and rotation of the hammer against the firing pin is prevented by the engagement of the sear 20 in the sear-receiving notch 32. In this position, the force of the hammer spring 42 on the sear 20 tends to rotate the sear counter-clockwise, as does the sear spring 26, and this in turn causes the rear arm 24 of sear 20 to press downwardly on the upper surface of trigger 16 holding same also in the cocked position. Thus, the hammer spring 42 and sear spring 26 both serve to retain the sear 20 in sear receiving notch 32, and to retain the trigger 16 in the cocked position.

Trigger 16 is provided with an adjusting screw 52 which is threaded into the base and the end of which bears against the under surface of a rearwardly extending arm 54 of trigger 16. When screw 52 is in the lowered position shown in FIG. 1 (twice actual size), the trigger 16 permits the sear 20 to pivot counter-clockwise until sear 20 lodges fully into notch 32 (see also FIG. 2 ten times actual size). However, when screw 52 is raised it lifts arm 54 of trigger 16 which in turn lifts arm 24 of sear 20 and the sear 20 further out of notch 32.

The present invention stems from the discovery that when the trigger 16 is pulled and the sear 20 in turn forces the hammer 28 backwardly against spring 28, the force required to move the hammer comes not only from spring 28 but also from the rather substantial friction-viscosity bonds in the combined spring, piston cam and rod components; and that there is a portion of the resistance curve of the hammer in which the hammer can be moved a short distance before the full frictional resistance of the other components takes its effect. It is believed that this is due in part to resilience in the moving parts. Thus, for a small distance the hammer 28 can rotate counter-clockwise and the piston 44 and rod 50 can bend while no rotation of cam 46 takes place in socket 48. Such motion can be induced by a comparatively light trigger pull. With the parts so arranged (see FIG. 3) I find that firing can be accomplished with a static pull of only about 2 ½ to 3 ½ lbs. whereas full motion (see FIG. 2) requires 7 to 9 lbs. On the other hand, since the hammer-bearing corner 36 clearly overlaps the sear-bearing corner 40, and hammer-bearing surface 34 presents the normal acute angle to its path of travel, any random jarring forces have the same tendency to hold the sear 20 in the notch 32 as they do in the gun when it is in the conventional adjustment. The only forces capable of acting otherwise are inertial forces related to the sear 20 and the trigger 16. The sear 20, however, is substantially balanced around the pin 22 and random inertial changes therefore have no effect on it. The trigger 16 might react to an upward inertial force, but in the present arrangement, no trigger spring is used and the full force of sear spring 26 resists such motion of the trigger. Thus, the gun is still essentially safe and even though the sear spring 26 is arranged to act against the trigger pull, it has only a relatively light force, and firing can be safely accomplished with a great total reduction in trigger pull force. The dimensional relationships whereby the required motion of the various related elements is reduced to the point where a substantial number of the friction bonds in the moving parts need not be broken during the trigger-pull stroke, is important. This point is difficult to determine empirically but it can be found by normal test procedures in which the screw 52 is adjusted to a hair trigger position at which the hammer-bearing corner 36 and the sear-bearing corner 40 are approximately on center. At such a point the gun is essentially unstable and will misfire if subjected to random shocks. The desired position for the practice of this invention is attained by adjusting screw 52 backwardly until the hammer-bearing corner 36 is slightly above center, and surface 34 bears against sear-bearing corner 40. At this point the force required to pull the trigger is minimal, but because the designed acute angle of surface 34 relative to its path of travel is preserved, the danger of misfiring is virtually eliminated.

It will now be seen that the adjustment is reversible, and any desired degree of "hair trigger" can be provided without permanent alteration of the gun. When the corners 36 and 40 wear as they will inevitably do during use, the screw 52 can be backed off to accommodate the change. Care must naturally be taken to be sure that wear and/or over-fine adjustments are avoided. This can be done by cocking the gun without loading it and then testing the gun for response to random shocks after a desired trigger setting has been made. Such testing is, of course, standard procedure before each period of use.

Various modifications of the preferred embodiment will now be apparent to those skilled in the art, and therefore it is not my intention to confine the invention to the precise form herein shown but rather to limit it in terms of the appended claims.

I claim:

1. A firing mechanism for a gun comprising; a base; a firing hammer mounted on said base to move from beyond a cocked position to a firing position at which the hammer strikes a firing pin; a cam-receiving socket in said hammer; firing spring and cam means having moving contacting surfaces and a rounded driving end mounted between said base and said hammer such that said rounded driving end engages said cam-receiving socket in ball and socket relation for urging said hammer from said cocked position toward said firing position; a sear-receiving notch in said hammer having a sear-bearing wall terminating in a sear-bearing corner; a sear mounted on said base having a hammer-bearing surface terminating in a hammer-bearing corner complementarily to the bearing portions of the sear receiving notch; said sear mounted on said base with said hammer-bearing surface and said sear-bearing corner in contact with each other when the firing mechanism is in the cocked position and said hammer-bearing surface presenting an acute angle in relation to its path of motion whereby the force of said firing spring on said hammer, at least in part, holds said sear in the cocked position; sear spring means for urging said hammer-bearing corner of said sear into said sear receiving notch; trigger means for moving said sear to release said sear from said notch to fire said gun; said hammer-bearing corner spaced from said sear-bearing corner by a dimension substantially equal to the distance the sear-bearing corner travels, when the trigger is pulled prior to substantially completely encountering the frictional resistance of the moving contacting surfaces of said firing spring and cam means; whereby firing said gun is accomplished with reduced force and trigger motion without impairment of safety.

2. The firing mechanism of claim 1 further characterized by said trigger means being free to pivot without spring means directly applied to it, and being urged to the cocked position only by the sear and firing springs.

3. The firing mechanism of claim 1 further characterized by a pivotal mount for said sear and said sear being light and substantially balanced about its pivot.

4. The firing mechanism of claim 1 further characterized by adjusting means bearing on said trigger means for adjustably placing said hammer bearing surface and said hammer bearing corner in the desired spacial relationship.

* * * * *